US006115569A

United States Patent [19]

Akutsu

[11] Patent Number: 6,115,569

[45] Date of Patent: Sep. 5, 2000

[54] PROCESS CARTRIDGE HAVING PROJECTION MEMBERS FOR MAINTAINING THE POSTURE OF THE PROCESS CARTRIDGE WHEN THE PROCESS CARTRIDGE IS MOUNTED ON THE BODY OF AN IMAGE FORMING APPARATUS

[75] Inventor: Takashi Akutsu, Toride, Japan

[73] Assignee: Canon Kabushiki Kaisha, Tokyo, Japan

[21] Appl. No.: 08/896,429

[22] Filed: Jul. 17, 1997

[30] Foreign Application Priority Data

Jul. 22, 1996 [JP] Japan ..... 8-211930

[51] Int. Cl.[7] ..... G03G 21/18

[52] U.S. Cl. ..... 399/111; 399/113

[58] Field of Search ..... 399/111, 110, 399/107, 113

[56] References Cited

U.S. PATENT DOCUMENTS

| | | | |
|---|---|---|---|
| 4,975,743 | 12/1990 | Surti | 399/111 |
| 5,221,943 | 6/1993 | Hasegawa | 399/111 |
| 5,669,042 | 9/1997 | Kobayashi et al. | 399/111 |
| 5,689,774 | 11/1997 | Shishido et al. | 399/111 |
| 5,734,949 | 3/1998 | Goto et al. | 399/111 |
| 5,745,823 | 4/1998 | Goto et al. | 399/111 |
| 5,802,432 | 9/1998 | Coffey et al. | 399/110 |
| 5,903,803 | 5/1999 | Kawai et al. | 399/111 X |

FOREIGN PATENT DOCUMENTS

| | | |
|---|---|---|
| 0520802 | 12/1992 | European Pat. Off. . |
| 0586044 | 3/1994 | European Pat. Off. . |
| 0708387 | 4/1996 | European Pat. Off. . |

*Primary Examiner*—Susan S. Y. Lee

*Attorney, Agent, or Firm*—Fitzpatrick, Cella, Harper & Scinto

[57] ABSTRACT

The present invention relates to a process cartridge removably mounted on a body of an electrophotographic image forming apparatus. The process cartridge includes an electrophotographic photosensitive drum, a process device acting on the electrophotographic photosensitive drum, a cartridge frame having side surfaces, and projection members for maintaining a posture of the process cartridge when the process cartridge is mounted on the body of the image forming apparatus. The projection members project outwardly from the side surfaces of the cartridge frame substantially in a same direction as an axis of the electrophotographic photosensitive drum. The projection members are positioned at a portion adjacent to an upper surface of the process cartridge when the process cartridge is mounted on the main body of the image forming apparatus.

39 Claims, 11 Drawing Sheets

PROCESS CARTRIDGE HAVING PROJECTION MEMBERS FOR MAINTAINING THE POSTURE OF THE PROCESS CARTRIDGE WHEN THE PROCESS CARTRIDGE IS MOUNTED ON THE BODY OF AN IMAGE FORMING APPARATUS

BACKGROUND OF THE INVENTION

1. Field of the Invention

The present invention relates to a process cartridge and an electrophotographic image forming apparatus to which such a process cartridge can removably be mounted. The "electrophotographic image forming apparatus" is an image forming apparatus for forming an image on a recording medium by using an electrophotographic image forming system and may include, for example, an electrophotographic copying machine, an electrophotographic printer (such as a laser beam printer, LED printer and the like), an electrophotographic facsimile and an electrophotographic word processor.

The "process cartridge" may incorporate therein an electrophotographic photosensitive member, and a charge means, a developing means or a cleaning means as a cartridge unit which can removably be mounted on an image forming apparatus, or may incorporate therein an electrophotographic photosensitive member, and at least one of a charge means, a developing means or a cleaning means as a cartridge unit which can removably be mounted on an image forming apparatus, or may incorporate therein an electrophotographic photosensitive member and at least a developing means as a cartridge unit which can removably be mounted on an image forming apparatus. Since the process cartridge can be mounted on and dismounted from the image forming apparatus by the operator himself, the maintenance of the apparatus can be facilitated.

2. Related Background Art

In image forming apparatuses us ing a process cartridge, it is necessary to regulate a position and a posture of a process cartridge in a body of the image forming apparatus. That is to say, a position of a photosensitive drum of the process cartridge must be correctly determined with respect to the body of the im age forming apparatus. Thus, in general, cylindrical projections coaxial with a center line of the photosensitive drum protrude from both side (end) surfaces of the process cartridge and the cylindrical projections are received in positioning grooves of guide structures formed in the body of the image form ing apparatus, to thereby regulate the position of the process cartridge in the image forming apparatus. And, by abutting a regulating member provided on the body of the image forming apparatus against an upper portion of the process cartridge, the process cartridge is positioned in place (for example, see EP 520,802). This arrangement is excellent because the process cartridge can be positioned accurately with respect to the body of the image forming apparatus.

SUMMARY OF THE INVENTION

An object of the present invention is to provide a process cartridge and an electrophotographic image forming apparatus in which the process cartridge can be positioned accurately with respect to the body of the image forming apparatus.

Another object of the present invention is to provide a process cartridge and an electrophotographic image forming apparatus to which the process cartridge can removably be mounted, which have a projecting member protruding from a cartridge frame in substantially the same direction as an axis of an electrophotographic photosensitive drum to abut against a fixed portion provided on a body of the image forming apparatus to regulate rotation of the process cartridge.

DETAILED DESCRIPTION OF THE PREFERRED EMBODIMENTS

Now, an embodiment of the present invention will be explained with reference to the accompanying drawings. In the following explanation, a "width-wise direction" of a process cartridge B is referred to as a direction along which the process cartridge B is mounted on and dismounted from a body 14 of an image forming apparatus A and which coincides with a recording medium conveying direction. A "longitudinal direction" of the process cartridge B is referred to as a direction transverse to (substantially perpendicular to) the direction along which the process cartridge B is mounted on and dismounted from the body 14 of an image forming apparatus. This direction is parallel with a surface of the recording medium and is transverse to (substantially perpendicular to) the recording medium conveying direction. Further, "right" and "left" regarding the process cartridge are referred to as right and left sides of the recording medium conveying direction when the recording medium is viewed from the above.

Figure 1:
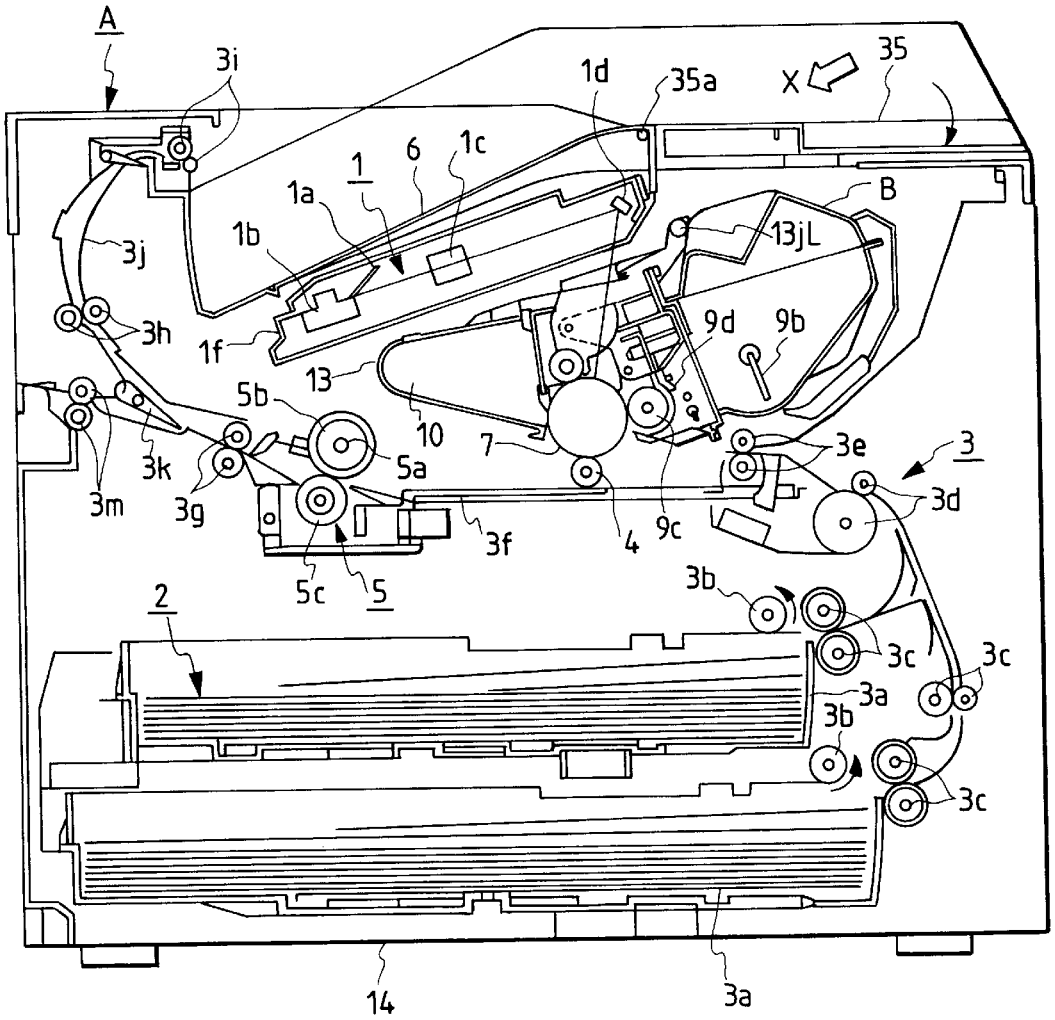
FIG. 1 is an elevational sectional view of an electrophotographic image forming apparatus according to an embodiment of the present invention.
Figure 2:
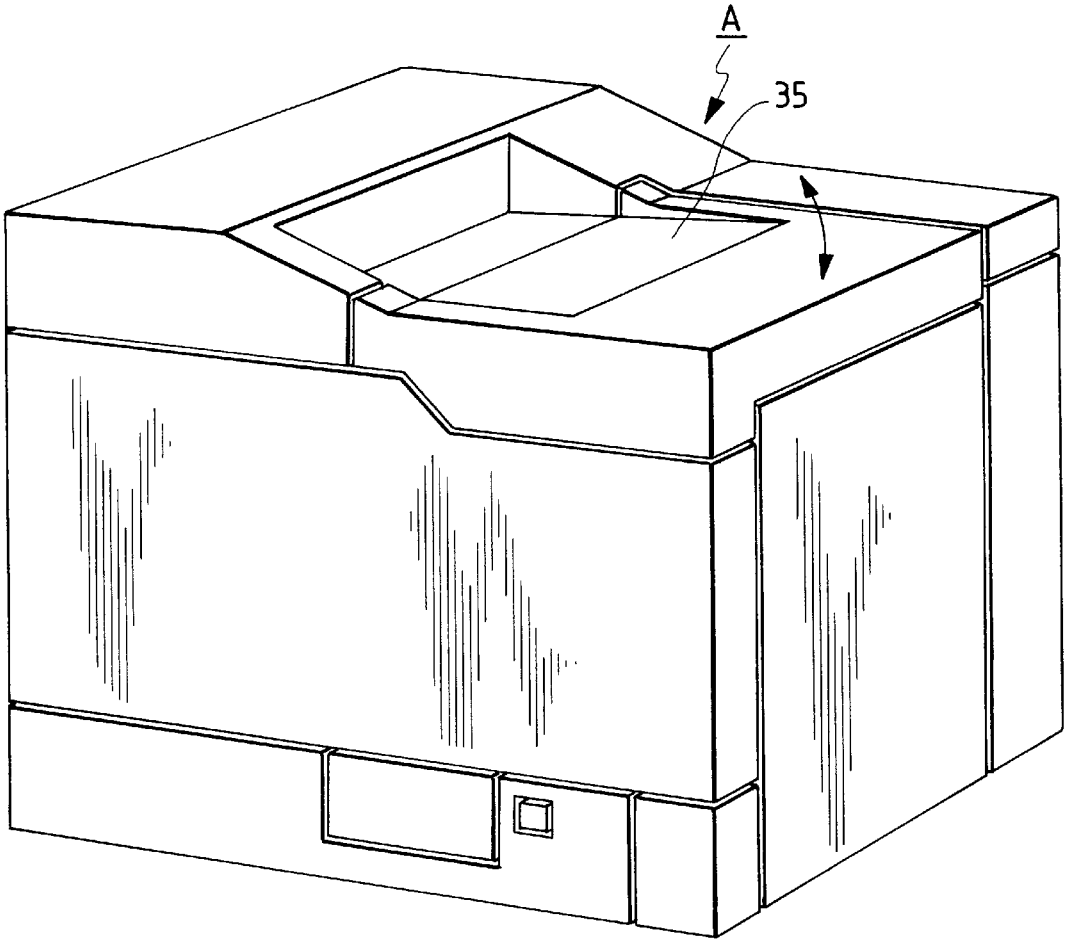
FIG. 2 is a perspective view of the image forming apparatus of FIG. 1.

FIG. 1 is a structural view of an electrophotographic image forming apparatus (laser beam printer) to which the embodiment of the present invention is applied, FIG. 2 is a perspective view of the image forming apparatus, and FIGS. 3 to 8 are views showing a process cartridge according to an embodiment of the present invention. In the following explanation, an "upper surface" of the process cartridge B is referred to as a surface facing up when the process cartridge B is mounted on the body 14 of the image forming apparatus, and a "lower surface" of the process cartridge is referred to as a surface facing down when the process cartridge is mounted on the image forming apparatus.

(Electrophotographic Image Forming Apparatus and Process Cartridge B)

A laser printer A shown in FIGS. 1 and 2 serves to form an image on a recording medium (for example, a recording sheet, an OHP sheet, a cloth and the like) by using an electrophotographic image forming process. First of all, a toner image is formed on a drum-shaped electrophotographic photosensitive member (referred to as "photosensitive drum" hereinafter). More specifically, the photosensitive drum is charged by a charge means, and then, a latent image corresponding to image information is formed on the photosensitive drum by illuminating the photosensitive drum with laser light from an optical means in response to the image information, and then, the latent image is developed by a developing means to form a toner image.

Synchronously with the formation of the toner image, the recording medium 2 is picked up from a sheet supply cassette 3*a* by a pick-up roller 3*b*, and the picked-up recording medium is conveyed by pairs of convey rollers 3*c*, 3*d* and a pair of regist rollers 3*e*. Then, the toner image formed on the photosensitive drum 7 of the process cartridge B is transferred onto the recording medium 2 by applying voltage to a transfer roller (transfer means) 4. The recording medium 2 to which the toner image was transferred is sent to a fixing means 5 through a convey guide 3*f*. The fixing means 5 comprises a drive roller 5*c*, and a fixing roller 5*b* including a heater 5*a* therein and serves to fix the toner image to the recording medium by applying heat and pressure. Thereafter, the recording medium 2 is conveyed through a reverse rotation path 3*j* by pairs of discharge rollers 3*g*, 3*h*, 3*i* to discharge the recording medium onto a discharge tray 6 formed on an upper surface of the body 14 of the image forming apparatus A. Incidentally, by operating a pivotal flapper 3*k*, the recording medium 2 can be discharged by a pair of discharge rollers 3*m* without passing through the reverse rotation path 3*j*. In the illustrated embodiment, a convey means 3 is constituted by the pick-up roller 3*b*, the pairs of convey rollers 3*c*, 3*d*, the pair of regist rollers 3*e*, the convey guide 3*f*, the pairs of discharge rollers 3*g*, 3*h*, 3*i* and the pair of discharge rollers 3*m*.

As shown in FIGS. 3 to 8, in the process cartridge B, the photosensitive drum 7 is rotated and the surface of the photosensitive drum is uniformly charged by applying voltage to a charge roller (charge means) 8. Then, laser beam light emitted from an optical system 1 in response to image information illuminates the photosensitive drum 7 through an exposure opening portion 1*e* to form a latent image, and the latent image is developed by a developing means 9 with toner. The charge roller 8 is contacts with the photosensitive drum 7 to charge the latter and is rotatingly driven by rotation of the photosensitive drum 7. The developing means 9 supplies the toner to a developing area of the photosensitive drum 7 to develop the latent image formed on the photosensitive drum 7. The optical system 1 has an optical case If containing a laser diode 1*a*, a polygon mirror 1*b*, a lens 1*c* and a reflection mirror 1*d*, which optical case If is attached to the body 14 of the image forming apparatus.

In the developing means 9, the toner contained in a toner container 11A is sent to a developing roller 9*c* by rotating a toner feed member 9*b*. The developing roller 9*c* having a fixed magnet therein is rotated, and a toner layer is formed on the developing roller 9*c* and is frictionally charged by a developing blade 9*d*. The toner is supplied from the toner layer to the developing area of the photosensitive drum 7, so that the latent image is visualized as the toner image by transferring the toner onto the photosensitive drum 7 in accordance with the latent image. The developing blade 9*d* serves to regulate a thickness of the toner layer on the developing roller 9*c* and apply the frictional charges to the toner. In the vicinity of the developing roller 9*c*, a toner agitating member 9*e* for circulating the toner in a developing chamber is provided.

After the toner image formed on the photosensitive drum 7 is transferred to the recording medium 2 by applying voltage having a polarity opposite to that of the toner image, residual toner remaining on the photosensitive drum 7 is removed by a cleaning means 10. In the cleaning means 10, the residual toner remaining on the photosensitive drum 7 is scraped from the photosensitive drum by an elastic cleaning blade 10*a* urged against the photosensitive drum 7, and the scraped toner is collected into a waste toner reservoir 10*b*.

The process cartridge B includes a toner frame 11 having the toner container (toner containing portion) 11A containing the toner, a developing frame 12 holding the developing means 9 including the developing roller 9*c* and the like, and a cleaning frame 13 to which the photosensitive drum 7, cleaning means (cleaning blade 10*a* and the like) and charge roller 8 are attached. These frames are joined to each other.

The exposure opening portion 1*e* through which the light corresponding to the image information is illuminated on the photosensitive drum 7, and a transfer opening portion 13*n* through which the photosensitive drum 7 faces to the recording medium 2 are formed in the process cartridge B. The exposure opening portion 1*e* is formed in the cleaning frame 13 and the transfer opening portion 13*n* is defined between the developing frame 12 and the cleaning frame 13. The process cartridge can be mounted on and dismounted from the body 14 of the image forming apparatus by the operator.

Next, a housing structure of the process cartridge B according to the illustrated embodiment will be described.

(Housing Structure of Process Cartridge B)

As mentioned above, the process cartridge B includes the toner frame 11, developing frame 12 and cleaning frame 13 which are joined to each other to form a housing which will be described hereinbelow.

Figure 3:
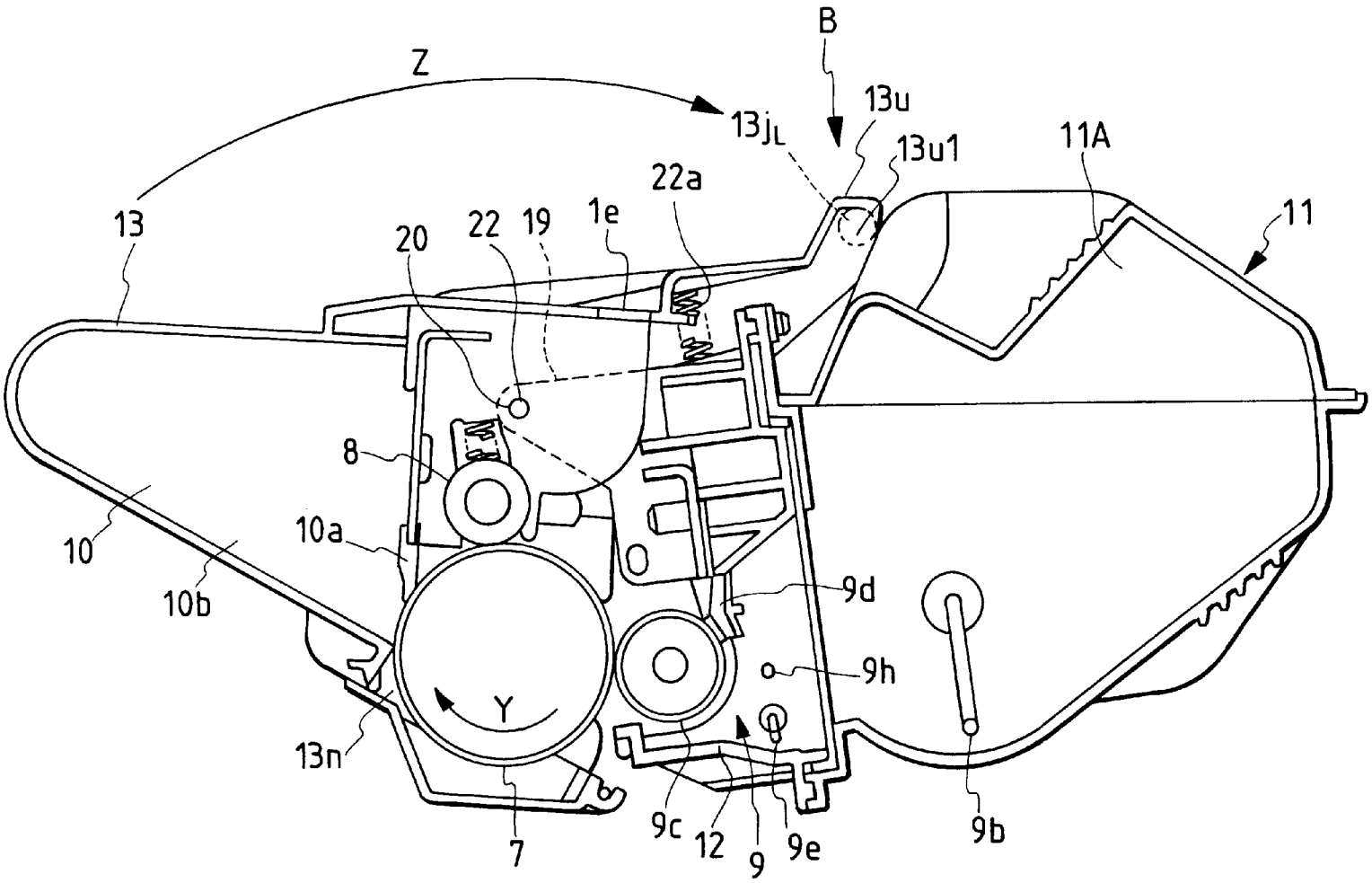
FIG. 3 is a sectional view of a process cartridge.
Figure 4:
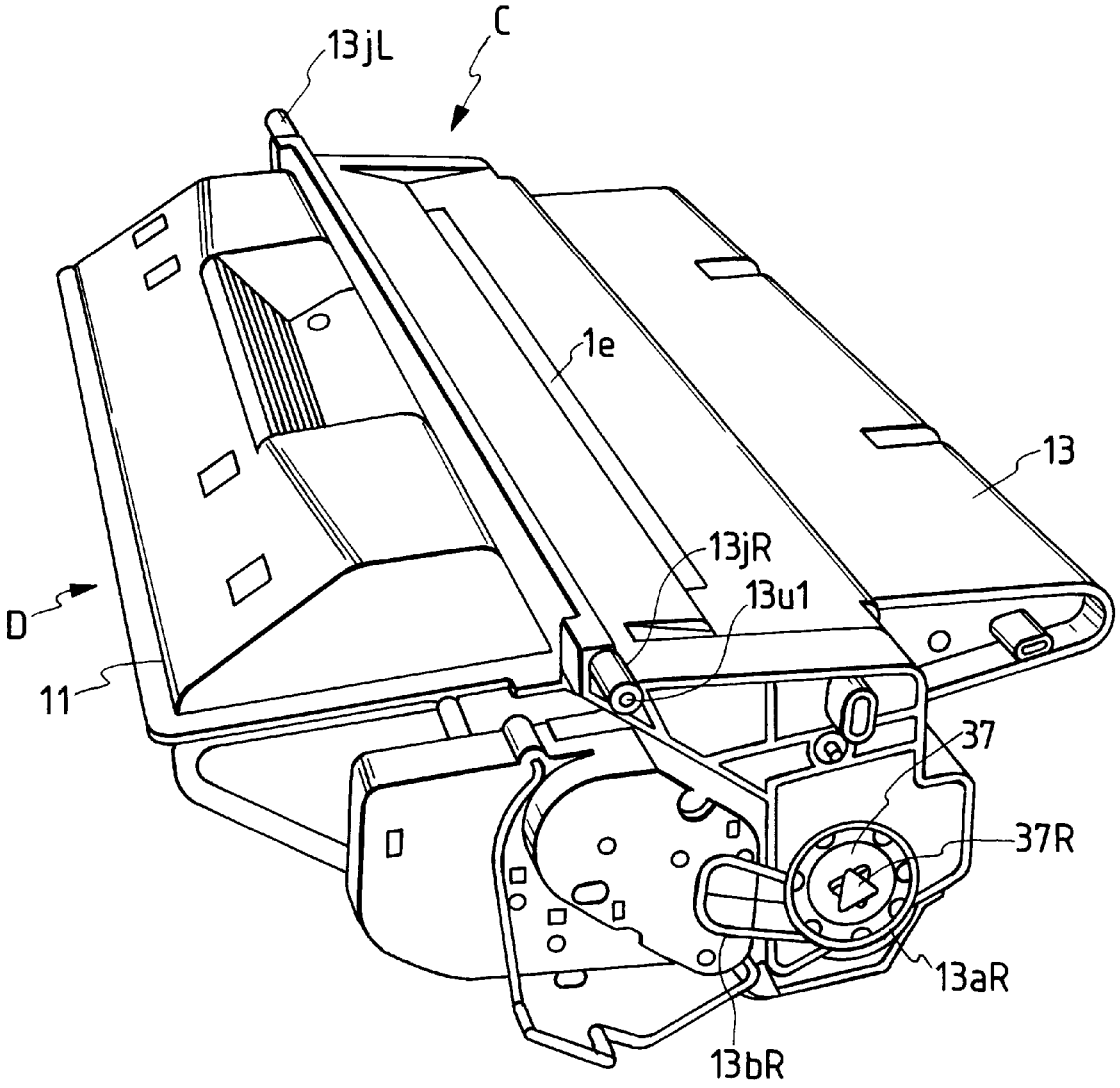
FIG. 4 is a perspective view of the process cartridge of FIG. 3, viewed from the right upper side thereof.

As shown in FIG. 3, the toner feed member 9*b* is rotatably attached to the toner frame 11, and the developing roller 9*c* and the developing blade 9*d* are attached to the developing frame 12 and the toner agitating member 9*e* for circulating the toner in the developing chamber is rotatably provided in the vicinity of the developing roller 9*c*. An antenna rod 9*h* extending substantially in parallel with the developing roller 9*c* is provided in an opposed relation to the developing roller 9*c*. The toner frame 11 and the developing frame 12 are welded (by ultrasonic welding in the illustrated embodiment) to each other to form a developing unit D (FIG. 12) as a second frame.

Figure 11:
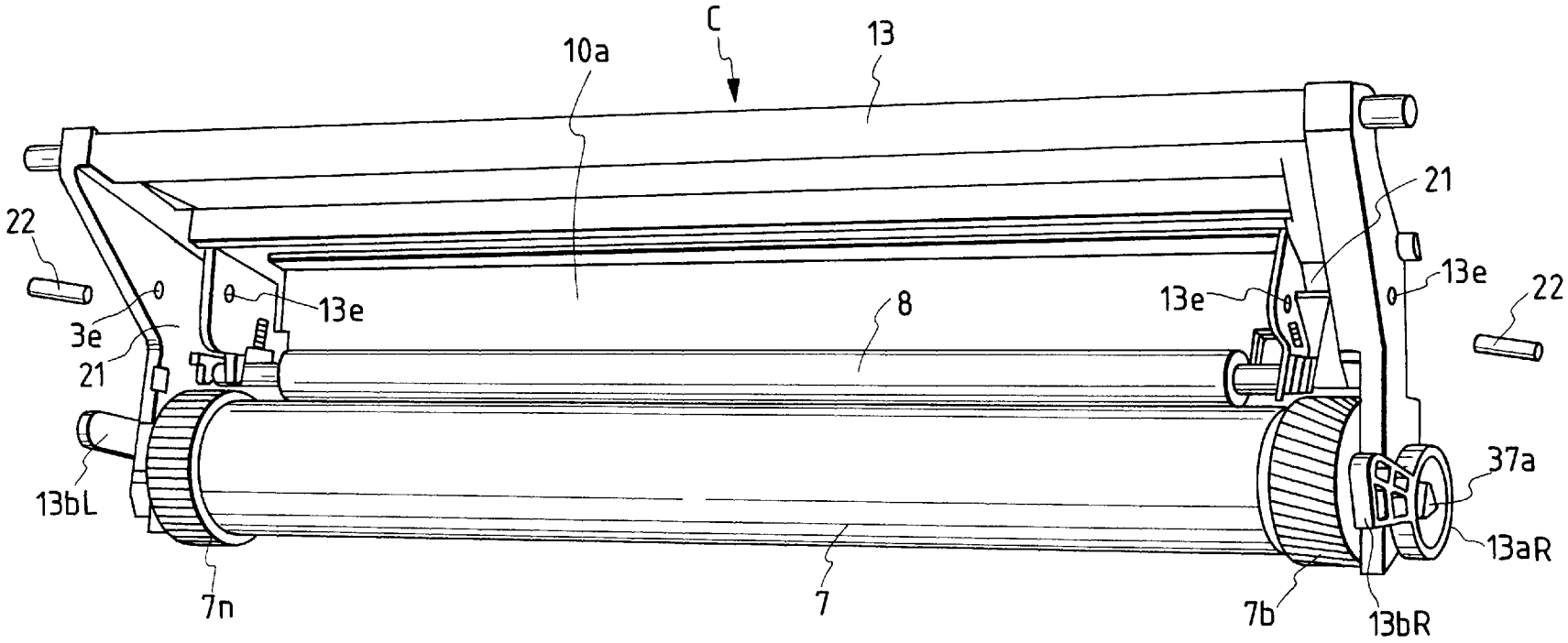
FIG. 11 is a perspective view of a cleaning unit.
Figure 12:
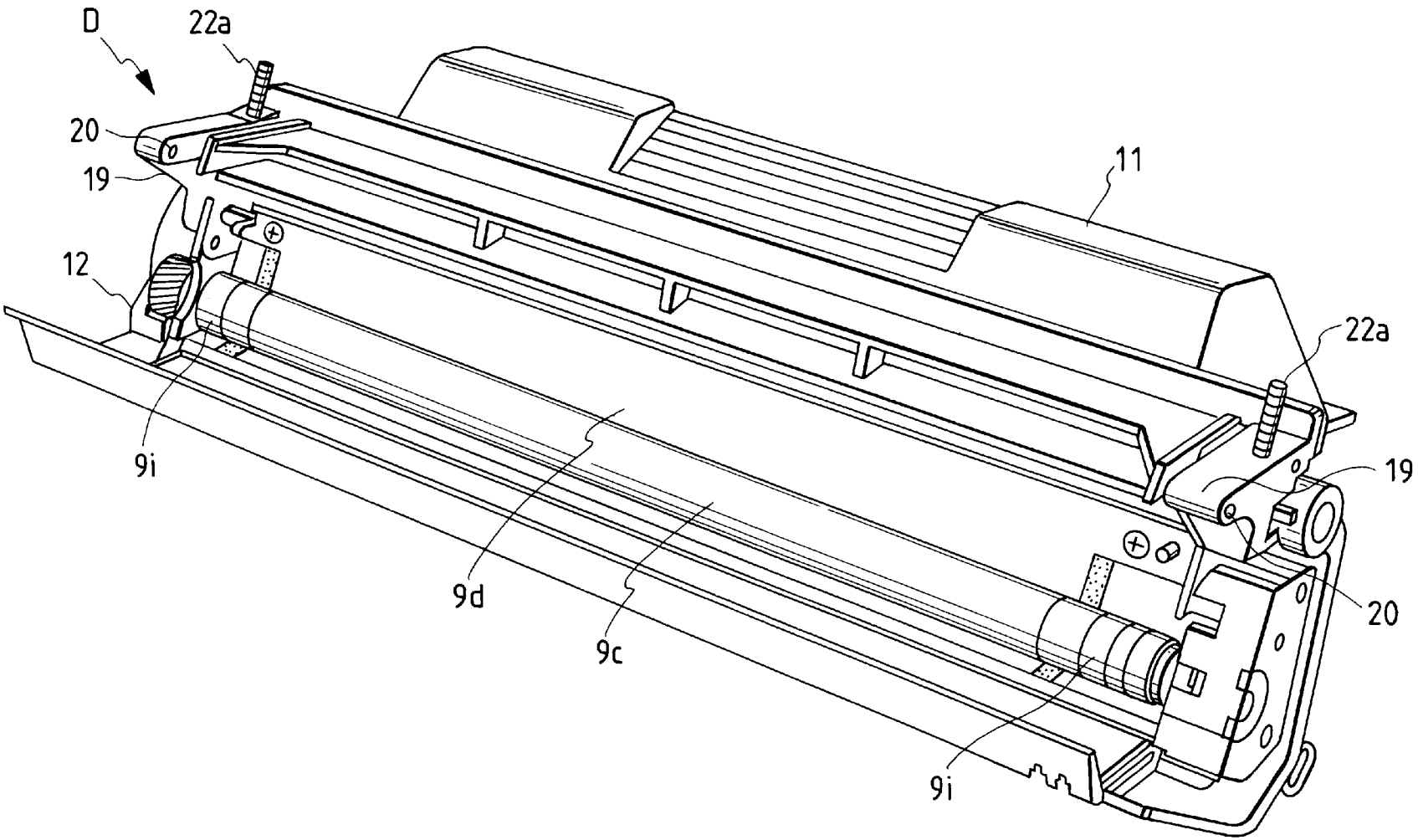
FIG. 12 is a perspective view of a developing unit.

As shown in FIGS. 3 and 11, the photosensitive drum 7, charge roller 8 and cleaning means 10 are attached to the cleaning frame 13 to form a cleaning unit C (FIG. 11) as a first frame. The process cartridge B is formed by rotatably interconnecting the developing unit D and the cleaning unit C by connecting members (pins) 22. Specifically, as shown in FIG. 12, circular pivot holes 20 (extending in parallel with the developing roller 9*c*) are formed in tip end portions 19*a* of arm portions 19 provided on both longitudinal ends of the developing frame 12 (along a longitudinal direction of the developing roller 9*c*). On the other hand, recessed portions 21 for receiving the arm portions 19 are formed in both longitudinal end portions of the cleaning frame 13 (see FIG. 11). By inserting the arm portions 19 into the recessed portions 21 and press-fitting the connection members 22 into attachment holes 13*e* of the cleaning frame 13 into the pivot holes 20 of the tip end portions of the arm portions 19, the developing unit D and the cleaning unit C are interconnected for pivotal movement around the connection members 22. In this case, compression coil springs 22*a* fitted on pins (not shown) formed on root portions of the arm portions 19 abut against upper surfaces of the recessed portions 21 of the cleaning frame 13 to bias the developing frame 12 downwardly, to thereby positively urge the developing roller 9*c* against the photosensitive drum 7.

The upper surfaces of the recessed portions 21 of the cleaning frame 13 are inclined so that the compression coil springs 22*a* are gradually compressed from a non-compressed condition when the developing unit D is assembled with the cleaning unit C. Hence, as shown in FIG. 12, by providing spacer rollers 9*i* each having a diameter greater than that of the developing roller 9*c* at both longitudinal ends of the developing roller 9*c*, the spacer rollers 9*i* are urged against the photosensitive drum 7, so that the developing roller 9*c* is opposed to the photosensitive drum with a predetermined gap (about 300 μm) therebetween. In this way, the developing unit D and the cleaning unit C can be pivoted relative to each other around the connection members 22, and a positional relation between the peripheral surfaces of the photosensitive drum 7 and the developing roller 9*c* can be maintained by the compression coil springs 22*a*.

Since the developing frame 12 has the compression coil springs 22*a* provided at the root portions of the arm portions 19, the spring forces of the compression coil springs 22*a* do not act on any portions other than the root portions. Thus, even if spring seats for the compression coil springs are not particularly reinforced (for example, by providing spring seat members at the root portions), accuracy can be ensured sufficiently because the root portions of the arm portions 19 have great strength and great rigidity.

As shown in FIG. 3, a cover portion 13*u* extending up to over the toner frame 11 to cover a part of the toner frame 11 and an upper portion of the developing frame 12, is provided on an upper surface of the cleaning frame 13. The cover portion 13*u* has a longitudinal upper wall, and side walls 13*u*1 suspended from both longitudinal ends of the upper wall in parallel with the plane of FIG. 3. A tip end of the cover portion 13*u* extending up to over the toner frame 11 is positioned upwardly of the photosensitive drum 7 near the developing unit D.

(Drive Mechanism for Process Cartridge)

The photosensitive drum 7 is provided at its both ends with drum flanges (not shown) and is rotatably supported by the cleaning frame 13 (also referred to as "drum frame" hereinafter). The photosensitive drum 7 is engaged by a drum gear 7*b* (FIG. 8) integrally formed with one of the drum flanges and a developing roller gear (not shown) secured to the end of the developing roller 9*c*. The developing roller gear meshes with a gear (not shown) for transmitting rotation to the toner feed member 9*b* and the toner agitating member 9*e*.

A coupling projection shaft 37 is integrally provided on the drum flange having the drum gear 7*b*, and the projecting shaft 37 is rotatably supported in a bearing integral with a right guide member 13R. A coupling projection 37*a* formed on a tip end of the coupling projecting shaft 37 is positioned within a cylindrical guide 13*a*R in a longitudinal direction. The coupling projection 37*a* has a triangular column shape twisted in an axial direction.

Figure 10:
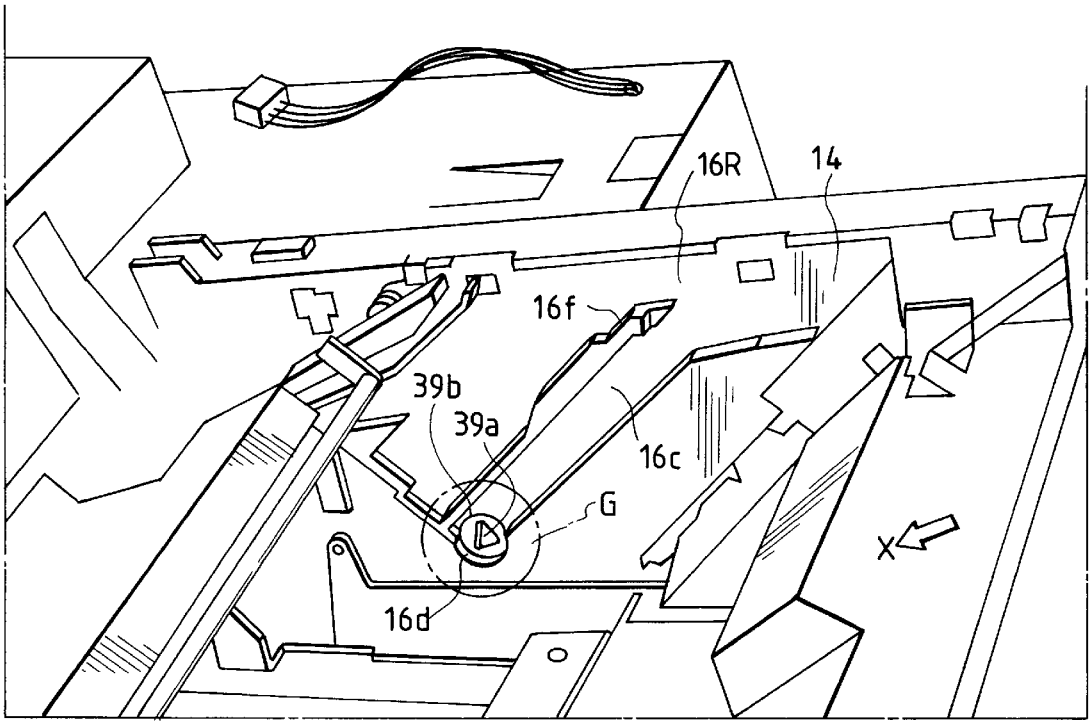
FIG. 10 is a perspective view showing a process cartridge mounting portion of the image forming apparatus, viewed from another direction.

There is provided a coupling recessed shaft 39*b* having a center the same as a center of a positioning groove 16*d* of a guide member 16R of the apparatus body 14 shown in FIG. 10 and shiftable between a position where the coupling recessed shaft projecting into the positioning groove 16*d* and a position where the coupling recessed shaft is retracted from the positioning groove 16*d*. The coupling recessed shaft 39*b* is positioned at the side of the apparatus body 14 and is connected to a rotation drive source via a power transmitting member. That is to say, the coupling recessed shaft 39*b* is positioned coaxial with a gear G. The coupling recessed shaft 39*b* is provided at its end face with a coupling recessed portion 39*a* having a triangular bore shape twisted in the axial direction. The coupling recessed portion 39*a* can be engaged with the coupling projection 37*a* of the process cartridge B, so that, upon engagement, these elements are pulled toward each other because these elements are twisted in the same direction. Further, since these elements 39*a*, 37*a* have substantially regular triangular shapes each having a rotational center, when they are rotated, self-centering is achieved.

The process cartridge according to the illustrated embodiment has the following construction. That is to say, the process cartridge is detachably mountable to a main assembly of the image forming apparatus, wherein the main assembly includes a motor (not shown), a main assembly side gear G for receiving a driving force from the motor and a hole 39*a* defined by twisted surfaces, the hole being substantially coaxial with the gear G, and the process cartridge comprises an electrophotographic photosensitive drum 7, process means 8, 9, 10 actable on the photosensitive drum 7, and a twisted projection 37*a* engageable with the twisted surfaces, the projection being provided at a longitudinal end of the photosensitive drum 7, wherein when the main assembly side gear G rotates with the hole 39*a* and projection 37*a* engaged with each other, rotational driving force is transmitted from the gear G to the photosensitive drum 7 through engagement between the hole 39*a* and the projection 37*a*.

When the process cartridge B is mounted on the body 14 of the image forming apparatus, an opening/closing member 35 is opened around a fulcrum 35*a* shown in FIG. 1. In this regard, there is provided an engagement/disengagement device (not shown) of shaft coupling type for cooperating the opening/closing member 35 with the coupling recessed shaft 39*b*. Thus, when the opening/closing member 35 is opened, the coupling recessed shaft 39*b* is retarded from the positioning groove 16*d* to disengage the coupling recessed portion (hole) 39*a* from the coupling projection 37*a* in the axial direction. Whereas, when the opening/closing member 35 is closed, the coupling recessed shaft 39*b* projects into the positioning groove 16*d* to engage the coupling recessed portion 39*a* with the coupling projection 37*a*. Accordingly, in a condition that the process cartridge B is mounted on the body 14 of the image forming apparatus, when the coupling recessed shaft 39*b* is driven by the drive source of the apparatus body 14 and the photosensitive drum 7 is driven through the coupling projecting shaft 37, as shown in FIG. 3, the photosensitive drum 7 is rotated in a direction shown by the arrow Y, to thereby act to produce a moment in a Z direction on the process cartridge B.

Figure 8:
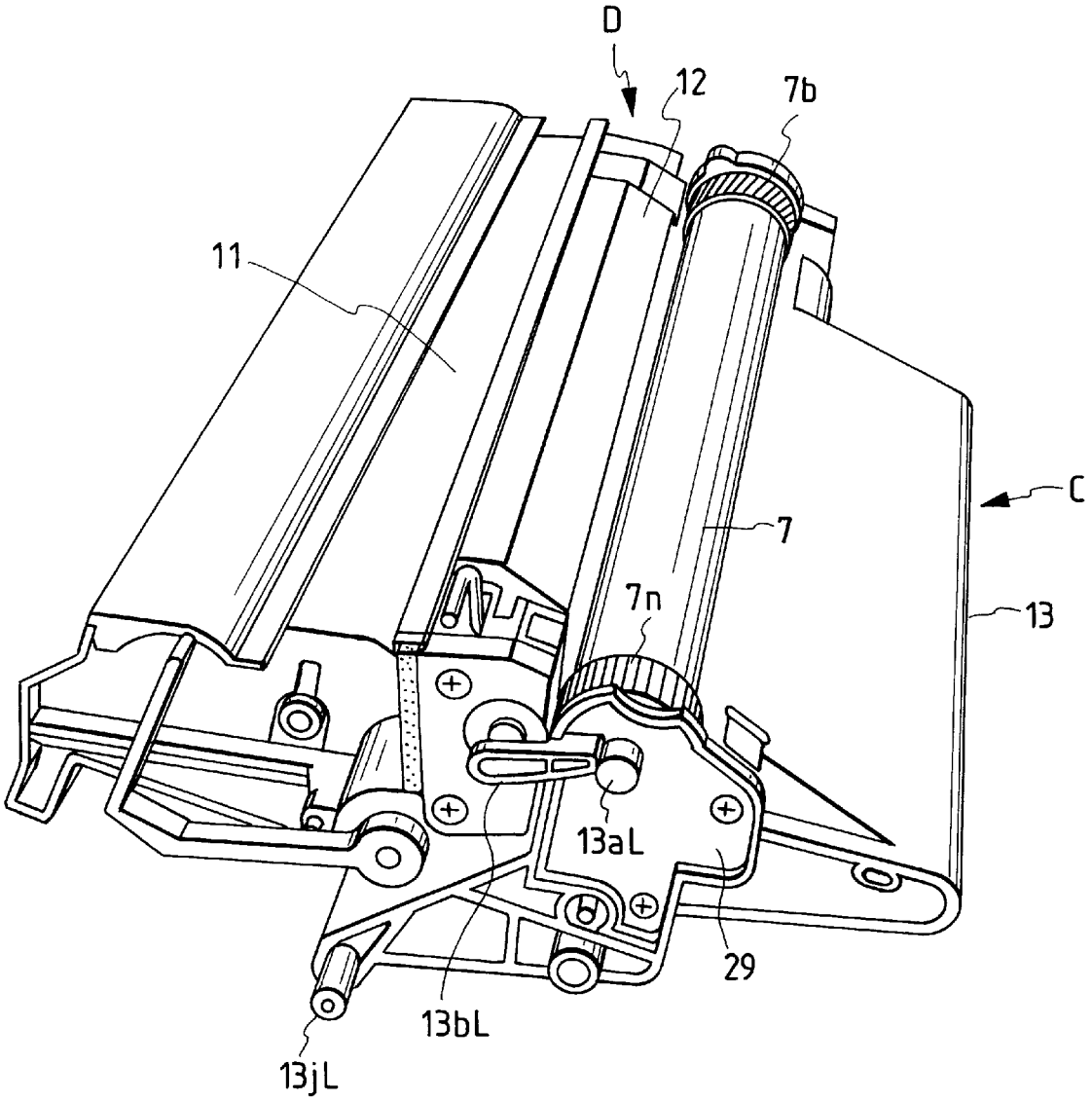
FIG. 8 is a perspective view showing a left lower side of the process cartridge of FIG. 3.

In the illustrated embodiment, while an example that the photosensitive drum 7 is driven through the shaft coupling was explained, even in a case where a drive gear (not shown) connected to the drive source of the apparatus body 14 and positioned below (above in FIG. 8) the drum gear 7*b* of FIG. 8 is engaged by the drum gear 7*b*, when the driving force is applied to the photosensitive drum 7 in FIG. 3, the Z direction moment acts on the photosensitive drum. Thus, the present invention can also be applied to the case where the drive gear is engaged by the drum gear 7*b*.

(Mounting Structure of Process Cartridge to Image Forming Apparatus)

Next, a guide means for guiding the process cartridge when the process cartridge is mounted on the apparatus body 14 and a positioning means for determining position and posture of the process cartridge after the process cartridge was mounted on the apparatus body 14 will be explained.

Figure 5:
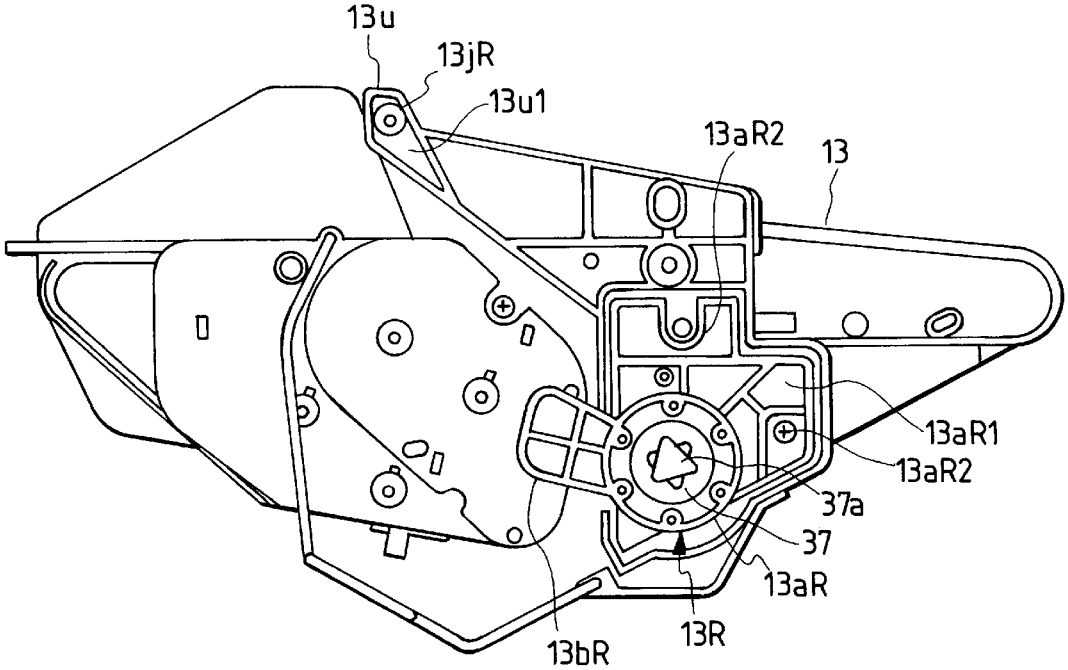
FIG. 5 is a right side view of the process cartridge of FIG. 3.
Figure 6:
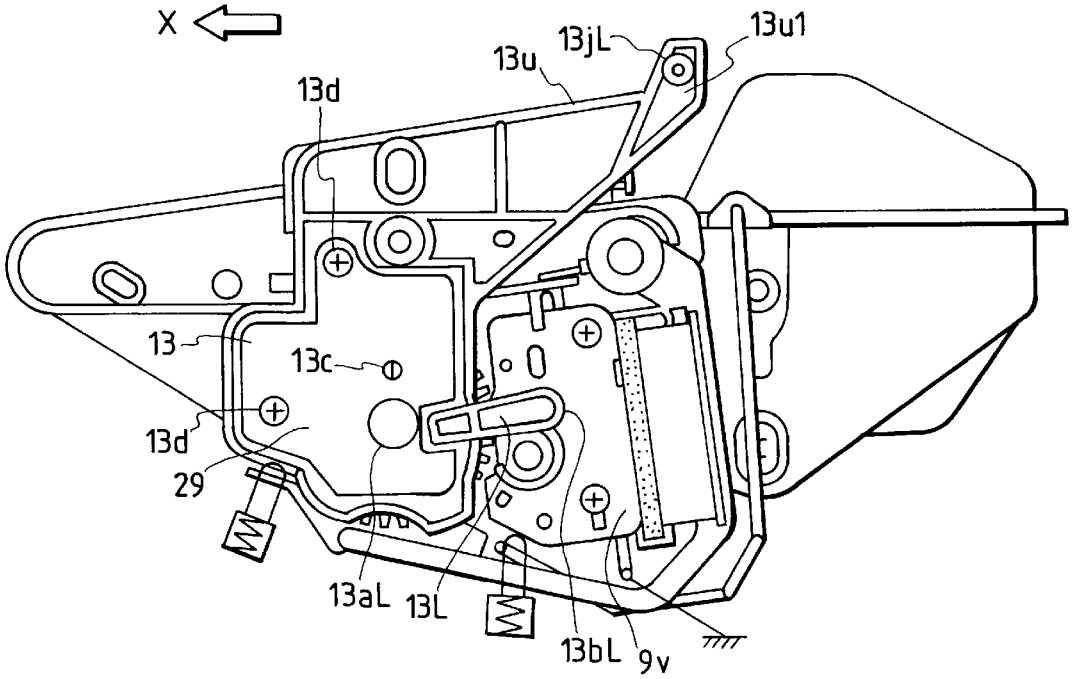
FIG. 6 is a left side view of the process cartridge of FIG. 3.
Figure 7:
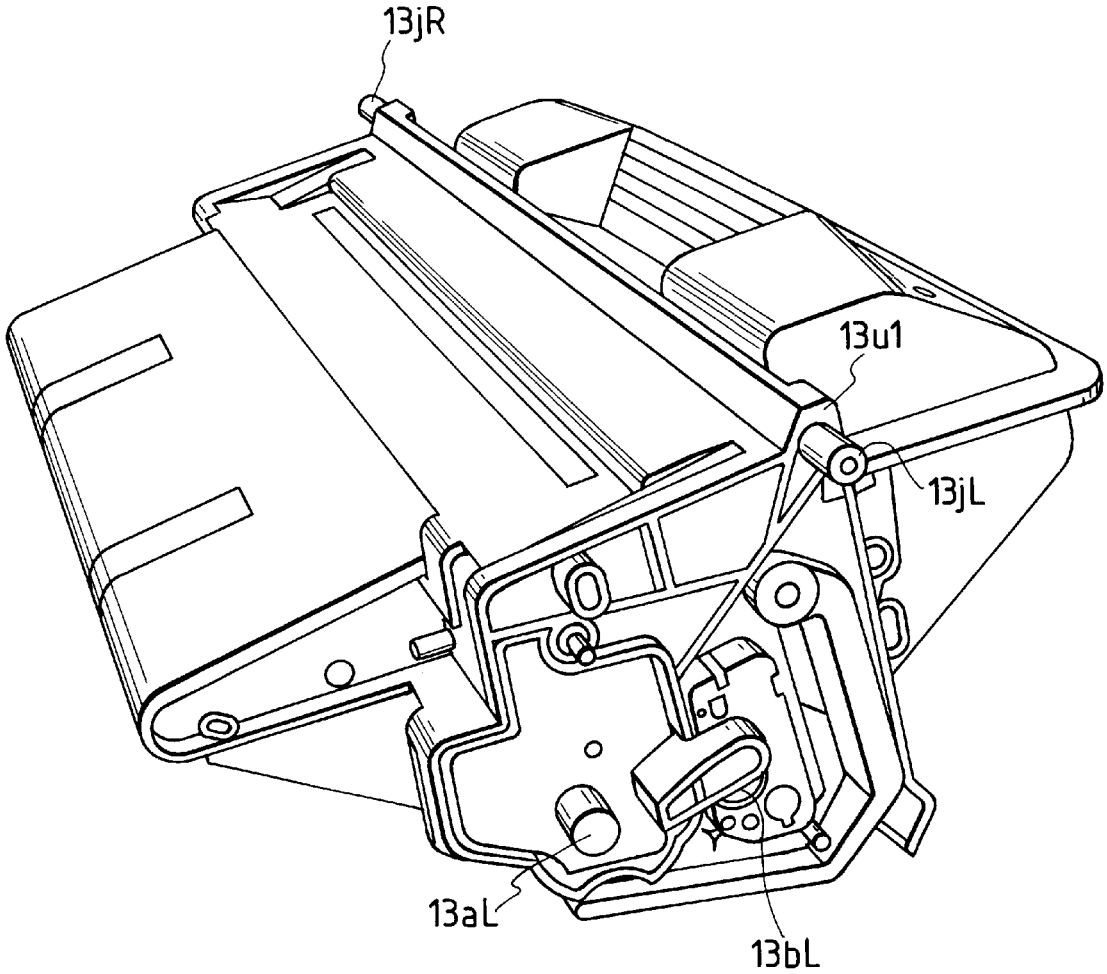
FIG. 7 is a perspective view of the process cartridge of FIG. 3, viewed from the left upper side thereof.

As shown in FIGS. 5, 6 and 7, in the process cartridge B, the cleaning frame 13 is provided at its both outer side surfaces with cylindrical guides (positioning guide means) 13*a*R, 13*a*L for guiding the process cartridge when the process cartridge is mounted on the body 14 of the image forming apparatus, and turn hampering guides (posture holding guide means) 13*b*R, 13*b*L. Further, there are provided regulating projections (posture regulating portions) 13*i*R, 13*j*L as positioning means when the process cartridge is mounted on the body 14 of the image forming apparatus. The position of the process cartridge B is regulated by the cylindrical guides 13*a*R, 13*a*L when the process cartridge is mounted on the apparatus body 14.

As shown in FIG. 5, the cylindrical guide 13*a*R is a cylindrical hollow member having an integral attachment flange 13*a*R1, and the turn hampering guide 13*b*R is formed integrally with the cylindrical guide 13*a*R and projects radially from the outer surface of the cylindrical guide. The right guide member 13 having such cylindrical guide 13*a*R, turn hampering guide 13*b*R and attachment flange 13*a*R1 is secured to the cleaning frame 13 by threading small screws 13*a*R2 into the cleaning frame through holes formed in the attachment flange 13*a*R1.

As shown in FIG. 6, the cylindrical guide 13*a*L is protruded outwardly (this side of the plane of FIG. 6) from a flat flange 29 fitted on a positioning pin c protruded from the side surface of the cleaning frame 13 and secured to the cleaning frame 13 by small screws 13*d*. The flange 29 is provided at its inner surface with a fixed drum shaft for rotatably supporting a spur wheel 7*n* integrally formed with a flange fitted in the photosensitive drum 7. The cylindrical guide 13*a*L is positioned in coaxial with the drum shaft.

As shown in FIG. 6, the elongated turn hampering guide 13*b*L slightly sp aced apart from the cylindrical guide 13*a*L and ext ending substantially radially of the cylindrical guide 13*a*L is formed integrally with the cleaning frame 13 to protrude laterally from the cleaning frame. A portion of the flange 29 which interferes with the turn hampering guide 13*b*L is cut away, and the lateral protruding height of the flange is substantially the same as that of the turn hampering guide 13*b*L. The turn hampering guide 13*b*L extends toward a side surface of a developing roller bearing box 9*v* secured to the developing frame 12. In this way, the left guide member 13L has the metallic cylindrical guide 13*a*L and the synthetic resin turn hamper ing guide 13*b*L as different members.

As shown in FIGS. 4 to 7, the regulating projections 13*j*R, 13*j*L are cylindrical hollow members composed of plastic maerial formed integrally with the cleaning frame 13 to protrude outwardly from the outer side surfaces of the cleaning frame in the longitudinal direction. The regulating projections 13*j*R, 13*j*L are positioned in the side walls 13*u*1 of the cover portion. Center lines of the regulating projections 13*j*R, 13*j*L coincide with each other and are substantially parallel with the center line of the photosensitive drum 7, but are sufficiently spaced apart from the center line of the photosensitive drum.

In the illustrated embodiment, a distance between the center of the photosensitive drum and the center of each regulating projection 13*j*R or 13*j*L is selected to about 75 mm. The lengths of the regulating projections 13*j*R, 13*j*L are smaller than those of the cylindrical guides 13*a*R, 13*a*L, and, thus, longitudinal free ends of the regulating projections 13*j*R, 13*j*L are protruded as the same as or smaller than those of the cylindrical guides 13*a*R, 13*a*L. Since the regulating projections 13*j*R, 13*j*L and the cylindrical guides 13*a*R, 13*a*L are provided on the cleaning frame 13, which is formed from the same material as these elements, the loads acting on the regulating projections 13*j*R, 13*j*L and the cylindrical guides 13*a*R, 13*a*L are supported by the cleaning frame 13 and do not affect other members. The regulating projections 13*j*R, 13*j*L project from both side surfaces of the cleaning frame 13 in directions substantially parallel with the axis of the photosensitive drum 7 and are positioned above the photosensitive drum when the process cartridge is mounted on the body of the image forming apparatus.

Figure 9:
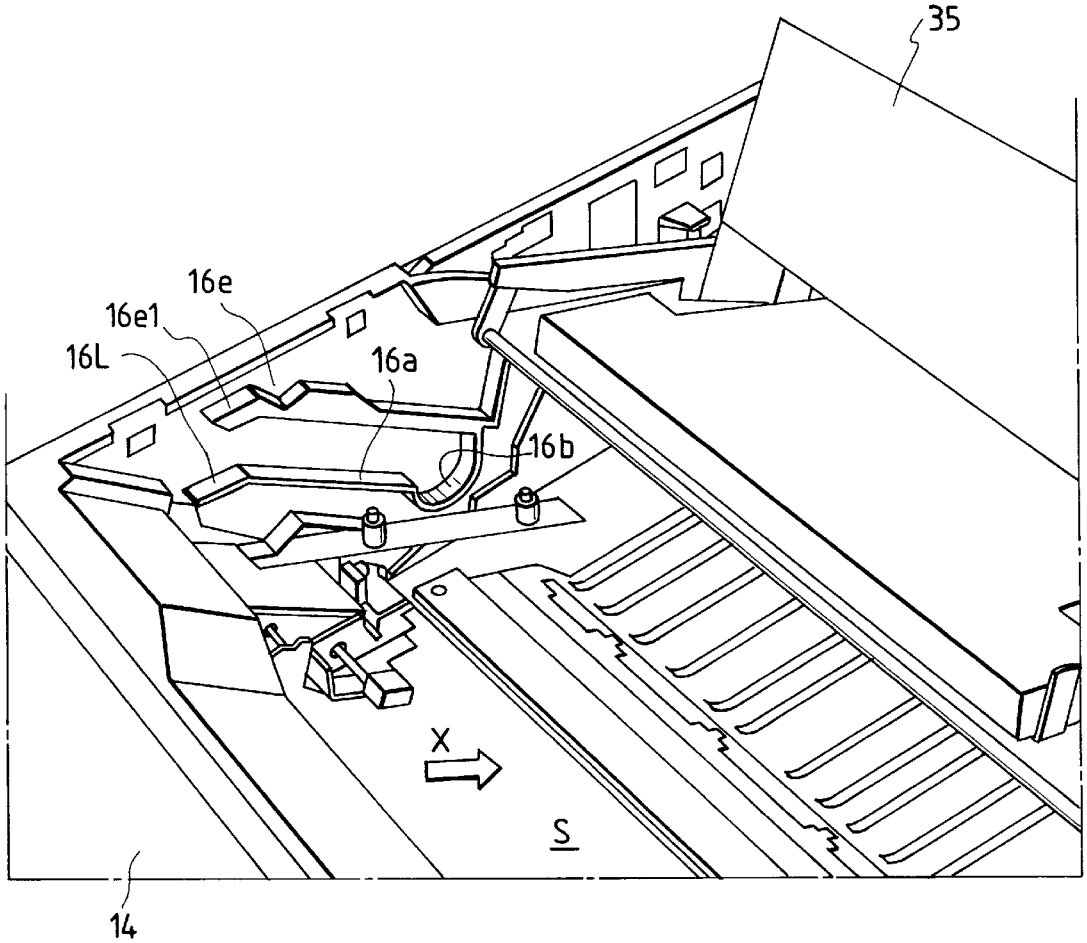
FIG. 9 is a perspective view showing a process cartridge mounting portion of the image forming apparatus.

The body 14 of the image forming apparatus is provided at its inner walls with a left guide member 16L (positioned at the left regarding the inserting direction X of the process cartridge B, in FIG. 9) and a right guide member 16R (positioned at the right regarding the inserting direction X of the process cartridge B, in FIG. 10).

The guide members 16L, 16R include, respectively, guide grooves 16*a*, 16*c* inclined downwardly along the inserting direction X of the process cartridge B, semicircular positioning recesses 16*b*, 16*d* contiguous to the guide grooves 16*a*, 16*c* to receive the cylindrical guides 13*a*L, 13*a*R of the process cartridge B, and posture regulating receiving portions 16*e*, 16*f* positioned above the guide grooves. The centers of the positioning recesses 16*b*, 16*d* are aligned with the centers of the cylindrical guides 13*a*L, 13*a*R of the process cartridge B and accordingly the center of the photosensitive drum 7 when the process cartridge B is mounted on the body 14 of the image forming apparatus. The posture regulating receiving portions 16*e*, 16*f* are provided in upper surfaces of upper walls defining the guide grooves 16*a*, 16*c*, and introduction portions 16*e*1, 16*f*1 for introducing the regulating projections 13*j*L, 13*j*R into the posture regulating receiving portions 16*e*, 16*f* are provided in front of the posture regulating receiving portions 16*e*, 16*f*.

The widths of the guide grooves 16*a*, 16*c* in the inserting direction of the process cartridge B are selected such that the cylindrical guides 13*a*L, 13*a*R are loosely received. Although the turn hampering guides 13*b*L, 13*b*R having widths smaller than diameters of the cylindrical guides 13*a*L, 13*a*R are loosely fitted, rotations of the cylindrical guides 13*a*L, 13*a*R and the turn hampering guides 13*b*L, 13*b*R are regulated by the guide grooves 16*a*, 16*c*, to thereby maintain the posture of the process cartridge B within a predetermined range. When the process cartridge B is mounted, the cylindrical guides 13*a*L, 13*a*R advance through the guide grooves 16*a*, 16*c*. As the process cartridge approaches the positioning recesses 16*b*, 16*d*, the regulating projections 13*i*L, 13*i*R abut against the introduction portions 16*e*1, 16*f*1 in front of the posture regulating receiving portions 16*e*, 16*f* and rides over ridges between the introduction portions 16*e*1, 16*f*1 and the posture regulating receiving portions 16*e*, 16*f* and then contact with the posture regulating receiving portions 16*e*, 16*f*. Then, while the regulating projections 13*i*L, 13*j*R are descending along the inclined surfaces of the posture regulating receiving portions 16*e*, 16*f*, the cylindrical guides 13*a*L, 13*a*R enter into and abut against the positioning recesses 16*b*, 16*d*.

That is to say, in a condition that the process cartridge B is mounted on the body 14 of the image forming apparatus, the cylindrical guides 13*a*L, 13*a*R of the process cartridge B are fitted into the positioning recesses 16*b*, 16*d* of the guide members 16L, 16R, and the regulating projections 13*j*L, 13*j*R provided on the outer surfaces of the cleaning frame 13 of the process cartridge B abut against the posture regulating receiving portions 16*e*, 16*f* of the guide members 16L, 16R of the apparatus body 14. This is the reason that, in the process cartridge B, when a center line connecting between the centers of the cylindrical guides 13*a*R, 13*a*L is maintained horizontally, regarding the cleaning unit C side and the developing unit D side on both sides of said center line, greater primary moment is generated in the developing unit D side than the cleaning unit C side.

When the image forming apparats A is driven, since the photosensitive drum 7 is rotated in the direction Y in FIG. 3, the process cartridge B is subjected to a moment in the Z direction. Thus, the regulating projections 13*j*L, 13*j*R continue to abut against the posture regulating receiving portions 16*e*, 16*f* of the guide members 16L, 16R of the body 14 of the image forming apparatus, so that the posture of the process cartridge B is maintained in the same condition as that before the image forming apparatus is driven.

By regulating the posture of the process cartridge B within the body 14 of the image forming apparatus in this way, since any members for regulating the posture of the process cartridge are not required to be provided in the cartridge mounting space S and the process cartridge is not required to be urged against such regulating members, as shown in FIG. 1, the process cartridge B can be approached to the optical case if, to thereby save the space accordingly. Since the regulating projections 13*j*R, 13*j*L are not longer than the cylindrical guides 13*a*R, 13*a*L of the process cartridge B in the longitudinal direction, the dimension of the apparatus body 14 is not required to be greater in the longitudinal direction. Specifically, in comparison with the conventional technique in which an upper part of the cleaning unit C is pressed by a member, since a space above the process cartridge B is not required (in the illustrated embodiment, since a space between the optical system 1 and the process cartridge B is not required (see FIG. 1), the height of the body 14 of the image forming apparatus can be reduced accordingly, to thereby make the apparatus body 14 compact.

Since the regulating projections 13*j*L, 13*j*R are situated on the side walls 13*u*1 of the cover portion 13*u* of the cleaning frame 13 in a sufficiently spaced relation (about 75 mm) to the center of the photosensitive drum, even if the regulating projections 13*j*L, 13*j*R and/or the posture regulating receiving portions 16*e*, 16*f* of the apparatus body 14 have positional deviation, such positional deviation does not produce a bad influence upon the posture of the process cartridge B. The distance between the center of the photosensitive drum 7 and the centers of the regulating projections 13*j*L, 13*j*R may be longer as much as possible. For example, when such distance is about 60 mm, if the positions of the regulating projections 13*j*L, 13*j*R are deviated by 1 mm in the rotational direction of the process cartridge B, the posture of the process cartridge will be changed by 1 degree. However, since the manufacturing error of the process cartridge effected by the molding operation is of the order of millimeter (0.1 mm or less), the posture of the process cartridge B is kept substantially constant.

The posture regulating receiving portions 16*e*, 16*f* of the apparatus body 14 include inclined surfaces against which the regulating projections 13*j*L, 13*j*R of the process cartridge B abut, and such inclined surfaces are inclined in the same direction as the guide grooves 13*a*, 13*c* in parallel with the guide grooves 13*a*, 13*c* or with greater inclination than the guide grooves 13*a*, 13*c*. When the inclinations of the regulating projections 13*j*L, 13*j*R are greater than those of the guide grooves 13*a*, 13*c*, a "click" feeling can be obtained when the process cartridge B is mounted on or dismounted from the body 14 of the image forming apparatus. Each posture regulating receiving portion 16*e*, 16*f* is defined by one surface of the illustrated corresponding V-shaped groove, i.e., by a front surface viewed from the inserting direction X of the process cartridge B. Thus, in the condition that the process cartridge B is mounted on the body 14 of the image forming apparatus, generatrices of the regulating projections 13*j*L, 13*j*R of the process cartridge B are contacted with the front surfaces (viewed from the inserting direction X of the process cartridge B) of the V-shaped grooves, and the outer peripheral surfaces of the cylindrical guides 13*a*L, 13*a*R of the process cartridge B abut against the inner peripheral surfaces of the positioning recesses 16*b*, 16*d* of the guide members 16L, 16R of the apparatus body 14.

Incidentally, in the illustrated embodiment, although the posture regulating receiving portions 16*e*, 16*f* provided in the guide members 16L, 16R of the apparatus body 14 are flat, such portions may have secondary curved surfaces such as concave or convex are having a longitudinal axis. Further, the posture regulating portions of the process cartridge B are not limited to the cylindrical projections.

As mentioned above, according to the illustrated embodiment, the process cartridge detachably mountable to the body of the image forming apparatus comprises the electrophotographic photosensitive member, the process means acting on the electrophotographic photosensitive member, and the cartridge frame including the electrophotographic photosensitive member and the process means therein and having the guides for detachably mounting the process cartridge to the body of the image forming apparatus. The guides include the positioning guides coaxial with the electrophotographic photosensitive member, the turn hampering guides cooperating with the positioning guides to maintain the posture of the process cartridge when the process cartridge is mounted on the body of the image forming apparatus, and the posture regulating portions for abutting against the members of the apparatus body to keep the mounting condition of the process cartridge constant by cooperation with the positioning guides in the condition that the process cartridge is mounted on the body of the image forming apparatus. The posture regulating portions have the projections protruding from both side surfaces of the cartridge frame in the same direction as the axial direction of the electrophotographic photosensitive member and disposed above the electrophotographic photosensitive member at the heavier side of the cartridge frame regarding the center of the electrophotographic photosensitive member. With this arrangement, since it is not required that any posture regulating members should not abut against the process cartridge, the space for such posture regulating members can be saved, to thereby make the apparatus compact.

In the above illustrated embodiment, since the posture of the process cartridge is regulated by the projections provided on side surfaces of the frame of the process cartridge, the regulation of the posture of the process cartridge does not affect an influence upon the cleaning ability. As a result, since the rigidity of the cleaning frame 13 near the toner reservoir 10*b* may be not so great, the thickness of the cleaning frame can be reduced. Since the posture regulating portions are disposed above the electrophotographic photosensitive member at a position spaced apart from the electrophotographic photosensitive member by 60 mm or more, the positional accuracy of the posture regulating portions does almost not affect an influence upon the posture of the process cartridge.

In the illustrated embodiment, since the cartridge frame is formed by interconnecting the plurality of frames and the posture regulating portions are provided on the frame supporting the electrophotographic photosensitive member and having the positioning guides, the positional relation between the positioning guides and the posture regulating portions can easily be determined with high accuracy. Since the posture regulating portions are formed integrally with the cartridge frame, there is no assembling error.

In the illustrated embodiment, since the frame including the posture regulating portions is the cleaning frame having the electrophotographic photosensitive member, the charge means for charging the electrophotographic photosensitive member and the cleaning means for removing the residual toner remaining on the electrophotographic photosensitive member after the transferring, the posture regulating portions are not provided on the other frame. Thus, since only the dimension of the cleaning frame may be controlled, the dimensions of other members may not be controlled.

In the illustrated embodiment, the cleaning frame is pivotally connected to the developing frame of the developing unit formed by integrally joining the toner frame containing the toner to the developing frame supporting the developing member, and the cover portion having the spring seats for supporting, between the developing frame and the cover portion, the springs for applying the urging force between the electrophotograhic photosensitive member and the developing member extends toward the developing frame, and the posture regulating portions are provided on the tip end of the cover portion. With this arrangement, both the positioning guides and the posture regulating portions can be arranged in the same frame and the distance between the positioning guides and the posture regulating portions can be increased. Further, the loads acting on the positioning guides and the posture regulating portions can be reduced, and, since these elements are formed in the same frame, the loads do not influence the other elements.

In the illustrated embodiment, since the posture regulating portions comprise the cylindrical members having the center lines parallel with the axis of the electrophotographic photosensitive member, the insertion and removal of the posture regulating portions of the process cartridge can be smoothly effected with respect to the posture regulating receiving portions of the body of the image forming apparatus. Since the posture regulating portions are shorter than the positioning guides and the turn hampering guides, the longitudinal dimension of the process cartridge can be reduced. Since the posture regulating portions are situated so that the surface thereof which abut against the body of the image forming apparatus when the process cartridge is mounted on the body of the image forming apparatus are positioned above the space in front of the turn hampering guides, the provision of the posture regulating receiving portions of the body of the image forming apparatus can be made easier.

In the image forming apparatus according to the illustrated embodiment, since the mounting means for removably mounting the process cartridge comprises the groove-shaped guide portions for loosely receiving the positioning guides and the turn hampering guides, the positioning recesses provided in the ends of the guide portions and adapted to receive the positioning guides, and the posture regulating receiving portions which are formed in the upper parts of the guide portions and against which the posture regulating portions of the process cartridge abut, the posture regulating receiving portions can easily receive the posture regulating portions of the process cartridge when the process cartridge is mounted on the image forming apparatus. That is to say, merely by inserting the positioning guides and turn hampering guides of the process cartridge into the guide portions of the apparatus body, the positioning guides of the process cartridge are aligned with the positioning recesses of the apparatus body, and the posture regulating portions of the process cartridge abut against the posture regulating receiving portions of the apparatus body, to thereby facilitate the mounting and dismounting of the process cartridge with respect to the body of the image forming apparatus.

In the illustrated embodiment, since the posture regulating receiving portions of the apparatus body are positioned between the entrance of the cartridge mounting portion and the positioning recesses, the member in which the posture regulating receiving portions are formed can be formed integrally with the guide members for guiding the process cartridge. Since the guide portions are inclined downwardly from the entrance of the cartridge mounting portion and the surfaces of the posture regulating receiving portions of the apparatus body with which the posture regulating portions of the cartridge frame are contact inclined in the same direction as the guide portions and greatly more than the guide portions, the "click" feeling can be obtained when the process cartridge is mounted on and dismounted from the body of the image forming apparatus, so that the mounting and dismounting of the process cartridge can be ascertained by the click feeling.

As mentioned above, according to the present invention, the process cartridge can be mounted on the body of the image forming apparatus with high accuracy.

What is claimed is:

1. A process cartridge removably mountable on a main body of an electrophotographic image forming apparatus, comprising:

an electrophotographic photosensitive drum;

process means acting on said electrophotographic photosensitive drum;

a cartridge frame; and projection members for maintaining a posture of the process cartridge when the process cartridge is mounted on said main body of the image forming apparatus, each of said projection members projecting outwardly from a side surface of said cartridge frame substantially in a same direction as an axis of said electrophotographic photosensitive drum to be positioned at a portion adjacent to an upper surface of said process cartridge when the process cartridge is mounted on said main body of the image forming apparatus.

2. A process cartridge according to claim 1, wherein said projection members are positioned at a heavier side of the process cartridge regarding the axis of said photosensitive drum in a direction transverse to said electrophotographic photosensitive drum.

3. A process cartridge according to claim 2, wherein said cartridge frame is constituted by joining a drum frame, a developing frame, and a toner frame together, and said projection members are provided on the drum frame supporting said electrophotographic photosensitive drum and having guide members for guiding said process cartridge in a predetermined direction of the main body of the electrophotographic image forming apparatus when said process cartridge is mounted to the main body of the electrophotographic image forming apparatus.

4. A process cartridge according to claim 3, wherein said projection members are formed integrally with said drum frame made of plastic material.

5. A process cartridge according to claim 3, wherein said drum frame on which said projection members are formed further supports a charge member for charging said electrophotographic photosensitive drum and a cleaning member for removing residual toner remaining on said electrophotographic photosensitive drum.

6. A process cartridge according to claim 5, wherein said drum frame is joined to a developing unit formed by integrally joining said toner frame containing toner to said developing frame supporting said developing member, and a cover portion having spring seats for supporting, between a developing frame and said cover portion, springs for applying urging forces between said electrophotographic photosensitive drum and said developing member extending toward said developing frame, and the projection members are provided on a tip end of said cover portion.

7. A process cartridge according to claims 1, 2, 3, 4, 5, or 6, wherein said projection members are cylindrical members having center lines parallel with the axis of said electrophotographic photosensitive drum.

8. A process cartridge according to claims 3, 4, 5, or 6, wherein said projection members have outer ends positioned inwardly of outer ends of said guide members.

9. A process cartridge according to claim 1, further comprising guide members for guiding said process cartridge in a predetermined direction of the main body of the electrophotographic image forming apparatus when said process cartridge is mounted to the main body of the electrophotographic image forming apparatus, wherein said projection members have surfaces abutting against said main body of the image forming apparatus and are positioned above a space in front of said guide members of the process cartridge, when the process cartridge is mounted on said main body of the image forming apparatus.

10. A process cartridge according to claim 1, wherein said process means comprises at least one of a charge member for charging said electrophotographic photosensitive drum, a developing member for developing a latent image formed on said electrophotographic photosensitive drum, and a cleaning member for removing residual toner remaining on said electrophotographic photosensitive drum.

11. An electrophotographic image forming apparatus to which a process cartridge is removably mountable for forming an image on a recording medium, comprising:

(a) mounting means for removably mounting a process cartridge, said process cartridge including an electrophotographic photosensitive drum, process means acting on said electrophotographic photosensitive drum, a cartridge frame, and projection members for maintaining a posture of the process cartridge when the process cartridge is mounted on a main body of the image forming apparatus, each of said projection members projecting outwardly from a side surface of said cartridge frame substantially in a same direction as an axis of said electrophotographic photosensitive drum to be positioned at a portion adjacent to an upper surface of said process cartridge when the process cartridge is mounted on said main body of the image forming apparatus; and (b) a convey means for conveying the recording medium.

12. An electrophotographic image forming apparatus according to claim 11, wherein said mounting means comprises grooved-shaped guide portions for loosely receiving guide members of said process cartridge, positioning recesses provided in tip ends of said guide portions to receive said guide members, and posture regulating portions formed above said guide portions and against which said projection members abut.

13. An electrophotographic image forming apparatus according to claim 12, wherein said posture regulating portions are positioned between an entrance of said mounting means and said positioning recesses.

14. An electrophotographic image forming apparatus according to claim 12, wherein said guide portions are inclined downwardly from an entrance of said mounting means, and surfaces of said posture regulating portions of the main body of the image forming apparatus with which said projection members of the cartridge are contacted are inclined in the same direction as said guide portions and more steeply than said guide portions.

15. A process cartridge removably mountable to a main body of an image forming apparatus, wherein said main body includes a motor, a driving rotatable member for receiving a driving force from said motor and a hole defined by twisted surfaces, said hole being substantially coaxial with said driving rotatable member, said process cartridge comprising:

an electrophotographic photosensitive drum;

a cartridge frame;

process means actable on said photosensitive drum;

a twisted projection provided at a longitudinal end of said photosensitive drum to be engaged with said twisted surfaces, when said driving rotatable member rotates with said hole and projection engaged with each other, a rotational driving force being transmitted from said driving rotatable member to said photosensitive drum through engagement between said hole and said projection; and projection members for maintaining a posture of the process cartridge when the process cartridge is mounted on the main body of the image forming apparatus, each of said projection members projecting outwardly from a side surface of said cartridge frame substantially in a same direction as an axis of said electrophotographic photosensitive drum to be positioned at a portion adjacent to an upper surface of said process cartridge when the process cartridge is mounted on said main body of the image forming apparatus.

16. A process cartridge according to claim 15, wherein said projection members are positioned at a heavier side of the process cartridge regarding the axis of said photosensitive drum in a direction transverse to said electrophotographic photosensitive drum.

17. A process cartridge according to claim 16, wherein said cartridge frame is constituted by joining a drum frame, a developing frame, and a toner frame together, and said projection members are provided on the drum frame supporting said electrophotographic photosensitive drum and having guide members for guiding said process cartridge in a predetermined direction of the main body of the image forming apparatus when said process cartridge is mounted to the main body of the image forming apparatus.

18. A process cartridge according to claim 17, wherein said projection members are formed integrally with said drum frame made of plastic material.

19. A process cartridge according to claim 17, wherein said drum frame on which said projection members are formed further supports a charge member for charging said electrophotographic photosensitive drum and a cleaning member for removing residual toner remaining on said electrophotographic photosensitive drum.

20. A process cartridge according to claim 19, wherein said drum frame is joined to a developing unit formed by integrally joining said toner frame containing toner to a developing member, and a cover portion having spring seats for supporting, between said developing frame and said cover portion, springs for applying urging forces between said electrophotographic photosensitive drum and said developing member extends toward said developing frame, and the projection members are provided on a tip end of said cover portion.

21. A process cartridge according to claims 15, 16, 17, 18, 19, or 20, wherein said projection members are cylindrical members having center lines parallel with the axis of said electrophotographic photosensitive drum.

22. A process cartridge according to claims 17, 18, 19, or 20, wherein said projection members have outer ends positioned inwardly of outer ends of said guide members.

23. A process cartridge according to claim 15, further comprising guide members for guiding said process cartridge in a predetermined direction of the main body of the image forming apparatus when said process cartridge is mounted to the main body of the image forming apparatus wherein said projection members have surfaces abutting against said main body of the image forming apparatus and are positioned above a space in front of said guide members of the process cartridge, when the process cartridge is mounted on said main body of the image forming apparatus.

24. A process cartridge according to claim 15, wherein said process means comprises at least one of a charge member for charging said electrophotographic photosensitive drum, a developing member for developing a latent image formed on said electrophotbgraphic photosensitive drum, and a cleaning member for removing residual toner remaining on said electrophotographic photosensitive drum.

25. An electrophotographic image forming apparatus to which a process cartridge is removably mountable, and which includes:

(a) a motor;

(b) a driving rotatable member for receiving a driving force from said motor;

(c) a hole defined by twisted surfaces, said hole being substantially coaxial with said driving rotatable member;

(d) mounting means for removably mounting the process cartridge, said process cartridge including:

an electrophotographic photosensitive drum;

a cartridge frame;

process means actable on said photosensitive drum;

a twisted projection provided at a longitudinal end of said photosensitive drum to be engaged with said twisted surfaces, when said driving rotatable member rotates with said hole and projection engaged with each other, a rotational driving force being transmitted from said driving rotatable member to said photosensitive drum through engagement between said hole and said projection; and projection members for maintaining a posture of the process cartridge when the process cartridge is mounted on a main body of the image forming apparatus, each of said projection members projecting outwardly from a side surface of said cartridge frame substantially in a same direction as an axis of said electrophotographic photosensitive drum to be positioned at a portion adjacent to an upper surface of said process cartridge when the process cartridge is mounted on said main body of the image forming apparatus; and (e) convey means for conveying a recording medium.

26. An electrophotographic image forming apparatus according to claim 25, wherein said mounting means comprises grooved-shaped guide portions for loosely receiving guide members of said process cartridge, positioning recesses provided in tip ends of said guide portions to receive positioning guides, and posture regulating portions formed above said guide portions and against which said projection members abut.

27. An electrophotographic image forming apparatus according to claim 26, wherein said posture regulating portions are positioned between an entrance of said mounting means and said positioning recesses.

28. An electrophotographic image forming apparatus according to claim 26, wherein said guide portions are inclined downwardly from an entrance of said mounting means, and surfaces of said posture regulating portions of the main body of the image forming apparatus with which said projection members of the cartridge are contacted are inclined in a same direction as said guide portions and more steeply than said guide portions.

29. A process cartridge according to claim 1, further comprising positioning guides protruding from both side surfaces of said cartridge frame and positioned on a same axis as the axis of said electrophotographic photosensitive drum, said positioning guides engaging with receiving portions provided on the main body of the image forming apparatus when said process cartridge is mounted onto the main body and positions said process cartridge by cooperating with said projection members.

30. A process cartridge according to claim 29, further comprising a guide member provided on one of said side surfaces of said cartridge frame, said guide member guiding said process cartridge to a mounting position on the main body of said image forming apparatus when said process cartridge is mounted onto the main body.

31. A process cartridge detachably mountable to a main body of an image forming apparatus, said process cartridge comprising:

an electrophotographic photosensitive drum;

process means actable on said electrophotographic photosensitive drum;

a cartridge frame for supporting said electrophotographic photosensitive drum and said process means;

a first guide provided on a first portion of said cartridge frame adjacent to an end portion in an axial direction of said electrophotographic photosensitive drum of said cartridge frame, for guiding said process cartridge in a predetermined direction upon mounting of said process cartridge to the main body of said image forming apparatus, said first guide extending outwardly from said first portion in a direction coaxial with an axis of said electrophotographic photosensitive drum;

a second guide provided on said first portion at a position different from a position of said first guide;

a third guide provided on a second portion of said cartridge frame adjacent to an opposite end portion, in the axial direction of said electrophotographic photosensitive drum, of said cartridge frame for guiding said process cartridge in the predetermined direction upon mounting of said process cartridge to the main body, said third guide extending outwardly from said second portion in a direction coaxial with the axis of said electrophotographic photosensitive drum;

a fourth guide provided on said second portion at a position different from a position of said third guide;

a first projection member for maintaining a posture of the process cartridge by cooperating said first guide and said third guide when the process cartridge is mounted on the main body of the image forming apparatus, said first projection member projecting outwardly from said first portion of said cartridge frame substantially in a same direction as the axis of said electrophotographic photosensitive drum to be provided at a position adjacent to an upper surface of said process cartridge when the process cartridge is mounted on the main body of the image forming apparatus; and a second projection member for maintaining a posture of the process cartridge by cooperating said second guide and said fourth guide when the process cartridge is mounted on the main body of the image forming apparatus, said second projection member projecting outwardly from said second portion of said cartridge frame substantially in the same direction as the axis of said electrophotographic photosensitive drum to be provided at a position adjacent to the upper surface of said process cartridge, when the process cartridge is mounted on the main body of the image forming apparatus.

32. An electrophotographic image forming apparatus to which a process cartridge can be removably mounted for forming an image on a recording medium, comprising:

mounting means for removably mounting a process cartridge, said process cartridge including:

an electrophotographic photosensitive drum, process means actable on said electrophotographic photosensitive drum, a cartridge frame for supporting said electrophotographic photosensitive drum and said process means, a first guide provided on a first portion of said cartridge frame adjacent to an end portion in an axial direction of said electrophotographic photosensitive drum of said cartridge frame, for guiding said process cartridge in a predetermined direction upon mounting of said process cartridge to a main body of said image forming apparatus, said first guide extending outwardly from said first portion in a direction coaxial with an axis of said electrophotographic photosensitive drum, a second guide provided on said first portion at a position different from a position of said first guide, a third guide provided on a second portion of said cartridge frame adjacent to an opposite end portion, in the axial direction of said electrophotographic photosensitive drum, of said cartridge frame for guiding said process cartridge in the predetermined direction upon mounting of said process cartridge to the main body, said third guide extending outwardly from said second portion in a direction coaxial with the axis of said electrophotographic photosensitive drum, a fourth guide provided on said second portion at a position different from a position of said third guide, a first projection member for maintaining a posture of the process cartridge by cooperating said first guide and said third guide when the process cartridge is mounted on the main body of the image forming apparatus, said first projection member projecting outwardly from said first portion of said cartridge frame substantially in the same direction as the axis of said electrophotographic photosensitive drum, said first projection member to be provided at a position adjacent to an upper surface of said process cartridge when the process cartridge is mounted on the main body of the image forming apparatus, a second projection member for maintaining a posture of the process cartridge by cooperating said second guide and said fourth guide when the process cartridge is mounted on the main body of the image forming apparatus, said second projection member projecting outwardly from said second portion of said cartridge frame substantially in the same direction as the axis of said electrophotographic photosensitive drum to be positioned at a portion adjacent to the upper surface of said process cartridge, when the process cartridge is mounted on the main body of the image forming apparatus, and convey means for conveying the recording medium.

33. A process cartridge according to claim 31, wherein said first and said second projection members are positioned at a heavier side of the process cartridge regarding the axis of said photosensitive drum in a direction transverse to said electrophotographic photosensitive drum.

34. A process cartridge according to claim 31, wherein said first and said second projection members are formed integrally with said cartridge frame made of plastic material.

35. A process cartridge according to claim 31, wherein said first and said second projection members are cylindrical members having center lines parallel with the axis of said electrophotographic photosensitive drum.

36. A process cartridge according to claim 31, further comprising guide members for guiding said process cartridge in a predetermined direction of the main body of the image forming apparatus when said process cartridge is mounted to the main body of the image forming apparatus, wherein said first and said second projection members have surfaces abutting against the main body of the image forming apparatus and are positioned above a space in front of said guide members of the process cartridge, when the process cartridge is mounted on the main body of the image forming apparatus.

37. A process cartridge according to claim 31, wherein said process means comprises at least one of a charge member for charging said electrophotographic photosensitive drum, a developing member for developing a latent image formed on said electrophotographic photosensitive drum, and a cleaning member for removing residual toner remaining on said electrophotographic photosensitive drum.

38. A process cartridge according to claim 1 or 15, wherein when said process cartridge is mounted on the main body of the image forming apparatus, said projection members regulate a rotation of said process cartridge about the axis of said electrophotographic photosensitive drum to thereby regulate a position of said process cartridge.

39. A process cartridge according to claim 31, wherein when said process cartridge is mounted on the main body of the image forming apparatus, said first and said second projection members regulate a rotation of said process cartridge about the axis of said electrophotographic photosensitive drum to thereby regulate a position of said process cartridge.

* * * * *

UNITED STATES PATENT AND TRADEMARK OFFICE

CERTIFICATE OF CORRECTION

PATENT NO. : 6,115,569
DATED : September 5, 2000
INVENTOR(S) : Takashi Akutsu

It is certified that error appears in the above-identified patent and that said Letters Patent is hereby corrected as shown below:

Column 1,
Line 39, "us ing" should read -- using --.
Line 44, "im age" should read -- image --.
Line 49, "form ing" should read -- forming --.

Column 3,
Line 49, "is contacts with" should read -- contacts --.
Lines 55 and 56, "If" should read -- 1F --.

Column 4,
Line 25, "to" should be deleted.

Column 7,
Line 39, "in coaxial" should read -- coaxially --.
Line 42, "ext ending" should read -- extending --.
Line 52, "hamper ing" should read -- hampering --.

Column 8,
Line 4, "are protruded" should read -- protrude --; and "as the same as or" should read -- as much as or --; and "smaller" should read -- less --.
Line 56, "rides" should read -- ride --.

Column 9,
Line 9, "said center line," should read -- the center line, a --.
Line 12, "apparats" should read -- apparatus --.
Line 27, "can be approached" should read -- can approach --;
Line 28, delete "to" (first occurrence); and "iF," should read -- 1F, --.
Line 38, "1)," should read -- 1)), --.

Column 10,
Lines 22-23, "such as concave or convex are having a longitudinal axis." should read -- as concave or convex surfaces having a longitudinal axis --.
Line 60, "affect" should read -- have --.

Column 11,
Line 1, "does almost not affect an" should read -- has almost no --.
Line 51, "surface" should read -- surfaces --.

Column 12,
Line 21, "are contact" should read -- contact are --.

UNITED STATES PATENT AND TRADEMARK OFFICE

CERTIFICATE OF CORRECTION

PATENT NO. : 6,115,569
DATED : September 5, 2000
INVENTOR(S) : Takashi Akutsu

It is certified that error appears in the above-identified patent and that said Letters Patent is hereby corrected as shown below:

Column 13,
Line 10, "said" should read -- a --.

Column 15,
Line 30, "electrophotbgraphic" should read -- electrophotographic --.

Signed and Sealed this

Fourth Day of December, 2001

*Attest:*

Nicholas P. Godici

*Attesting Officer*

NICHOLAS P. GODICI
*Acting Director of the United States Patent and Trademark Office*